US008210624B2

(12) United States Patent
Jurja

(10) Patent No.: US 8,210,624 B2
(45) Date of Patent: Jul. 3, 2012

(54) SYMMETRICAL SELF-CLOSING MECHANISM FOR A DRAWER SLIDE

(75) Inventor: Samuel Jurja, Kitchener (CA)

(73) Assignee: Waterloo Furniture Components Ltd., Waterloo, Ontario (CA)

( * ) Notice: Subject to any disclaimer, the term of this patent is extended or adjusted under 35 U.S.C. 154(b) by 923 days.

(21) Appl. No.: 12/180,155

(22) Filed: Jul. 25, 2008

(65) Prior Publication Data

US 2009/0026902 A1 Jan. 29, 2009

Related U.S. Application Data

(60) Provisional application No. 60/951,878, filed on Jul. 25, 2007.

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.44, 334.46, 312/334.47, 319.1; 384/21, 22
See application file for complete search history.

(56) References Cited

U.S. PATENT DOCUMENTS

| | | | | |
|---|---|---|---|---|
| 6,652,050 | B2 * | 11/2003 | Lin | 312/333 |
| 7,077,487 | B2 * | 7/2006 | Yang | 312/333 |
| 7,159,958 | B1 * | 1/2007 | Lu | 312/334.44 |
| 7,244,005 | B1 * | 7/2007 | Lu | 312/333 |
| 7,347,515 | B1 * | 3/2008 | Lu | 312/333 |
| 7,441,848 | B2 * | 10/2008 | Chen et al. | 312/333 |
| 2005/0093406 | A1 * | 5/2005 | Yang | 312/333 |

FOREIGN PATENT DOCUMENTS

GB 2437482 * 10/2007

* cited by examiner

*Primary Examiner* — James O Hansen
(74) *Attorney, Agent, or Firm* — Daryl W. Schnurr

(57) ABSTRACT

A self-closing drawer slide has a housing with a linear channel extending therein at an inner end of an outer longitudinal section. A catch is slidably mounted within the channel and has pivot pins 36 extending out either side thereof (only one side is shown) into corresponding slots in the sides of the channel. The catch is symmetrical about a longitudinal centre line of the housing and rocks rearward to unlock and engage a latch on an inner longitudinal section and forward to lock and release the latch. The catch is biased to slide to an inner end of the channel when the catch is unlocked and there are no external forces on the slide.

16 Claims, 4 Drawing Sheets

SYMMETRICAL SELF-CLOSING MECHANISM FOR A DRAWER SLIDE

Applicant claims the benefit of U.S. Provisional Application Ser. No. 60/951,878 filed on Jul. 25, 2007.

BACKGROUND OF THE INVENTION

1. Field of the Invention

This invention relates to a self-closing drawer slide having a housing mounted on an inner end thereof with a catch in the housing that engages a latch on an inner section of the slide to move the slide to a closed position when the inner section moves within a pre-determined distance of the closed position.

2. Description of the Prior Art

It is known to have self-closing drawer slides with a housing affixed at an inner end of the outer slide member. In the Lee U.S. Pat. No. 7,083,243 issued Aug. 1, 2006, the housing has a channel with a cam slider 20 that operates by a leaf spring to move engaging jaws laterally to lock and unlock the cam slider within the channel and to simultaneously disengage and engage respectively an actuating pin in the inner slide member. The cam slide of Lee is relatively complex, expensive and subject to failure and it contains components that move relative to other components of the cam slider. The cam slider also contains a leaf spring that causes the components of the cam slider to move relative to one another. In addition, there is a second spring to move the cam slider along the channel of the housing. The cam slider described in the Lee patent has four separate components that must be assembled and three of the components are movable relative to one another and relative to the fourth component. While the channel of Lee is generally straight, the channel has two indentations to accommodate a reset feature that is also complex and subject to failure, particularly as the cam slider becomes worn with use.

The Lu U.S. Pat. No. 7,159,958, issued Jan. 9, 2007 describes a sliding rail assembly auto-locking structure for a drawer with a movable hook having a front guide rod and a rear guide rod that are coupled to sliding slots of a holder base. The movable hook 6 can pivot about the guide rod at the rear of the movable hook. A spring is connected to a locating device on one side of the movable hook.

The Lu U.S. Pat. No. 7,244,005, issued Jul. 17, 2007 describes a sliding rail assembly auto-locking structure for a drawer. The auto-locking structure has a holder base, a swivel hook connected to a slide 4 that is axially slidably mounted in a longitudinal sliding groove. Two return springs are fastened to hook portions of stop locks of the slide and there is a hydraulic cylinder fastened to a locating groove of the slide to buffer the return stroke of the slide.

Previous devices are complex, expensive, or they do not function properly as the actuator and hook disengage prematurely or cannot be easily reset when the slide moves to the inner end of the housing before engagement with the actuator, or they only function properly when manufactured within strict tolerances, or they fail to function properly when the actuator and hook become slightly worn through usage. Previous self-closing drawer slides that have a reset feature often have an actuator being forced over a hook, thereby increasing the wear between the actuator and the hook, or stretching these components if they are made to be flexible and thereby reducing the proper operation of the self-closing assembly, or causing the assembly to fail prematurely. Further, some previous devices have an actuator that only weakly engages a hook and when the drawer in which the slide is used is opened too quickly by a user, the actuator and hook disengage prematurely, causing the hook to move to the inner end of the housing under the force of the spring, and requiring the assembly to be reset before it can operate when the drawer is closed. Some self-closing mechanisms can only be reset by manually moving the hook into the locked position when the drawer is open.

SUMMARY OF THE INVENTION

It is an object of the present invention to provide a self-closing drawer slide having a catch that is slidable within a channel of a housing that is simple to operate and inexpensive to manufacture in one piece with no components of the catch that move relative to one another except when the re-set feature operates. It is a further object of the present invention to provide a catch and latch arrangement that is durable and has a fail safe reset feature.

A self-closing drawer slide comprises an outer longitudinal section and an inner longitudinal section mounted to telescopingly slide relative to one another, the slide being a side mounted drawer slide. A housing is fixedly secured at an inner end of the outer section, the housing having a catch in a locked position at or near an outer end thereof when the slide is in an open position. The catch is slidably mounted in a longitudinal linear channel formed in the housing. The catch is shaped to be engaged and unlocked in the channel with a latch on the inner slide when the latch contacts the catch as the slide moves from the open position of the slide to a closed position. The catch becomes disengaged from the latch and returns to the locked position as the inner section moves from the closed position toward the open position and the catch reaches an outer end of the channel as the latch moves past the housing. A spring extends between the catch and the housing to cause the catch to slide from the outer end of the housing along the channel to the inner end of the housing when the catch is in an unlocked position, the catch has a pivot access that is located substantially at a center of the catch between a forward end and a rearward end thereof. The catch at the outer end of the channel moves from the locked position to the unlocked position by rocking rearward and moves from the unlocked position to the locked position by rocking forward about the pivot axis.

A self-closing drawer slide comprises a plurality of longitudinal sections mounted to telescopingly slide relative to one another, the slide being a side mounted drawer slide. The sections are at least an outer section and an inner section. The housing is located at an inner end of the outer section, the housing having a longitudinal linear channel therein with a catch slidably mounted in the channel. The catch has a pivot axis that is located substantially at a center of the catch between a forward end and a rearward end thereof. The catch has a locked position and an unlocked position within the housing. In the locked position, the catch is locked at an outer end of the channel and in the unlocked position the catch is slidable from the outer end to the inner end of the channel. The catch is biased to the inner end of the channel by a spring to move the inner section and the slide to a closed position when the catch is unlocked. The catch moves from the locked position to the unlocked position by rocking rearward toward the rearward end and moves from the unlocked position to the locked position by rocking forward toward an forward end. The inner section has a latch at the inner end thereof, the latch being shaped to engage and simultaneously unlock the catch at the outer end of the channel when the inner section moves from an open position of the slide toward a closed position and to disengage and simultaneously lock the catch in the locked position when the inner slide moves from the inner end past the outer end of the housing as the slide moves toward the opening position.

A self-closing drawer slide comprises a plurality of longitudinal sections mounted to telescopingly slide relative to one another, the sections being at least an outer section and an inner section. A housing is affixed to an inner end of the outer section, the housing having a linear channel therein with a catch slidably mounted in the channel. The catch has a locked position at an outer end of the channel and an unlocked position. In the unlocked position, the catch is slidable from the outer end to the inner end of the channel, the catch being biased to the inner end of the channel by a spring. A latch is located at an inner end of the inner section, the latch and the catch being sized and shaped to interlock with one another when the catch is in the unlocked position and to disengage from one another as the inner section is moved toward an open position and the latch moves past the open end of the channel, the catch simultaneously moving to the locked position. The catch has a pivot axis that is located substantially at a center of the catch between a forward end and a rearward end thereof.

DETAILED DESCRIPTION OF A PREFERRED EMBODIMENT

Figure 1:
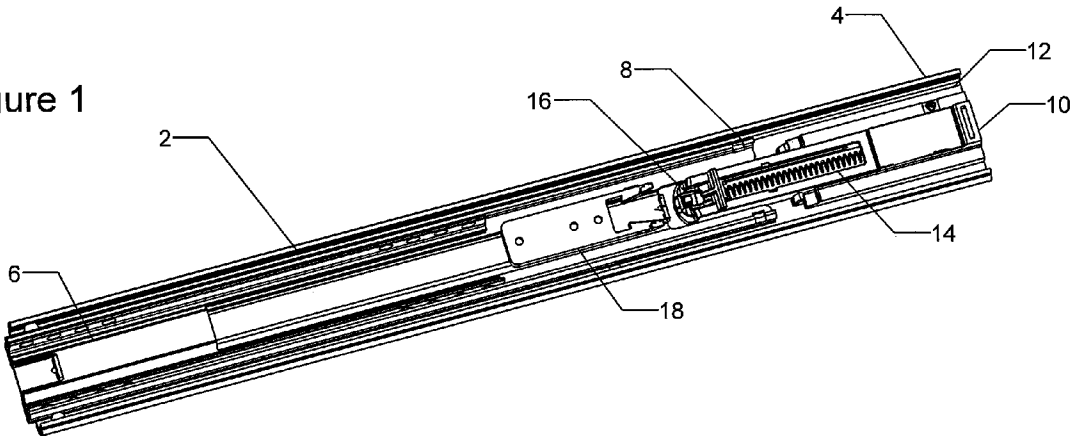
FIG. 1 is a perspective view of a drawer slide having three longitudinal sections that telescopingly slide relative to one another.

In FIG. 1, a drawer slide 2 has a plurality of longitudinal sections that telescopingly slide relative to one another. The sections are an outer section 4, an inner section 6 and an intermediate section 8. A housing 10 is affixed to an inner end 12 of the outer section 4. The housing 10 has a linear longitudinal channel 14 with a catch 16 shown in a locked position at an outer end of the housing 10. The inner section 6 has a latch 18 at an inner end thereof. The slide 2 is in an open position.

Figure 2:
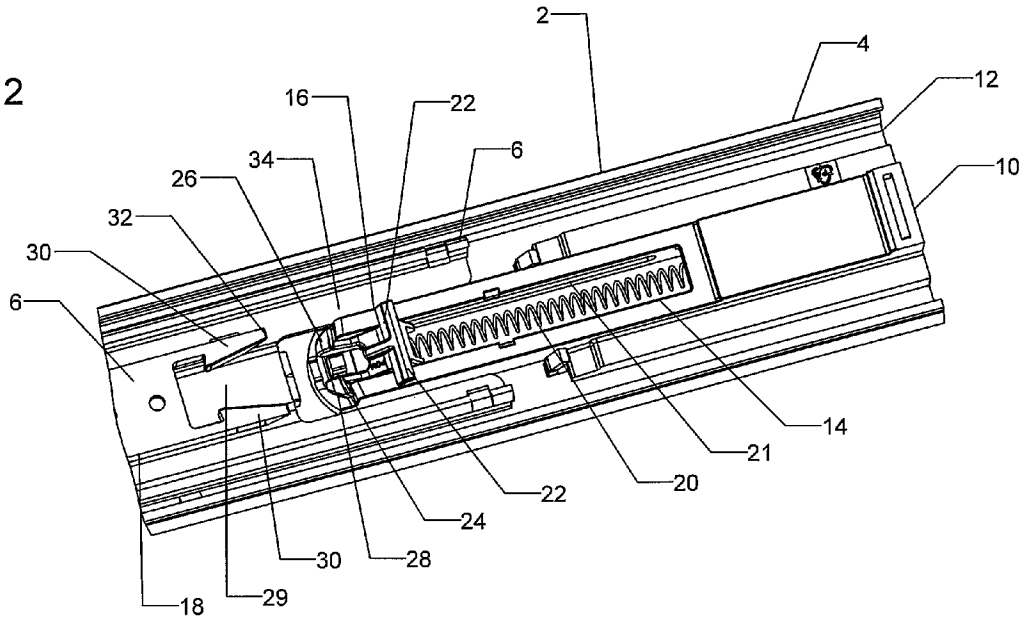
FIG. 2 is a partial perspective enlarged view of a housing having a catch and an inner section having a latch.

FIG. 2 is an enlarged perspective view of an inner end of the slide 2. The channel 14 contains a spring 20 that is connected to the catch 16 and biases the catch to slide along the channel 14 toward the inner end of the channel when the catch is in an unlocked position. The spring is connected to the inner end of the housing 10 but could alternatively be connected to the inner end 12 of the outer section 4. The catch in FIG. 2 is in a locked position. The catch rocks longitudinally rearward and forward toward the inner end 12 and toward an outer end of the slide respectively on a pivot axis (not shown in FIGS. 1 and 2) that extends across the housing into slots 21 (only one of which is shown) extending along each side of the channel 14. A rear portion 22 of the catch 16 is higher than a front portion 24 when the catch is in the locked position shown in FIG. 2. The front portion of the catch 16 has two legs 26 that are tapered on a front outer surface 28 thereof.

The latch 18 has a hollow T-shape 29 when viewed from the top that is sized and shaped to engage with the catch 16 when the latch 18 and the inner section 6 slide toward a closed position and the latch 18 contacts the catch 16. The latch 18 has two outer prongs 30 that each have a rear inner surface 32 that is parallel to the front outer surface 28 of the catch 16.

As the latch slides into contact with the catch, the prongs 30 contact the rear portion 22 causing the catch to rock rearward and the legs 26 simultaneously unlock from a front 34 of the housing 10 and flip up into what can be described as a top of the T-shaped portion of the latch 18. In this position, the latch is unlocked and the front portion 24 is higher than the rear portion 22 in the orientation shown in FIGS. 1 and 2. When the slide is installed as a side mounted slide, the orientation of the slide will be 90 degrees to that shown in FIGS. 1 and 2. Since the catch is unlocked, the spring 20 will cause the catch and therefore the inner section to move to the closed position at the inner end of the slide 2 when no external force is applied to the slide. In other words, when there are two slides installed on either side of a drawer, when a user moves the drawer toward the closed position, as soon as the latch engages and simultaneously unlocks the catch, the user can release the drawer and the two slides will move to the closed position by the force of the spring moving the catches that are engaged with the two latches to the closed position, thereby closing the drawer. When the drawer is being opened, the user will manually pull the drawer outward and when the catch reaches a front 34 of the housing 10, the catch will be stopped by the front end of the channel from sliding further. The catch will rock forward and return to the position shown in FIGS. 1 and 2 (i.e. to the locked position) while simultaneously disengaging from the latch 18 as the user continues to open the drawer and moves the inner section 6 and thereby the intermediate section 8 of the two slides further outward to fully open the drawer.

When the inner section is at the inner end of the inner section the slide is in the closed position. From the closed position to the position where the catch locks, the inner section is in a transitional possession. When the inner section disengages from the catch and moves further outward from the housing until the fully open position, the slide is said to be an open position.

In FIG. 2, the same reference numerals are used as those used in FIG. 1 for those components that are identical. In FIGS. 3-6, the same reference numerals are used as those used in FIGS. 1 and 2 for those components that are identical.

Figure 3:
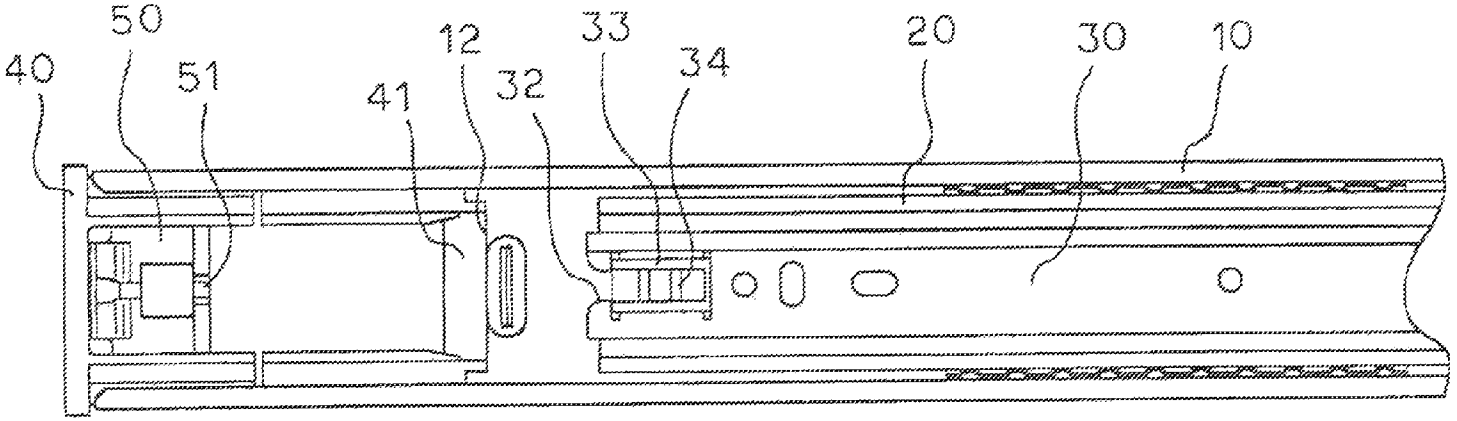
FIG. 3 is a schematic perspective view of the latch just prior to engaging the catch.

In FIG. 3, the catch 16 is in the locked position at the inner end of the channel 14 and the latch 18 is nearly in contact with the catch 16. The position of the inner section and the housing shown in FIG. 3 is the position that access just before the latch engages the catch when the slide is being closed and just after the latch disengages from the catch when the slide is being opened.

Figure 4:
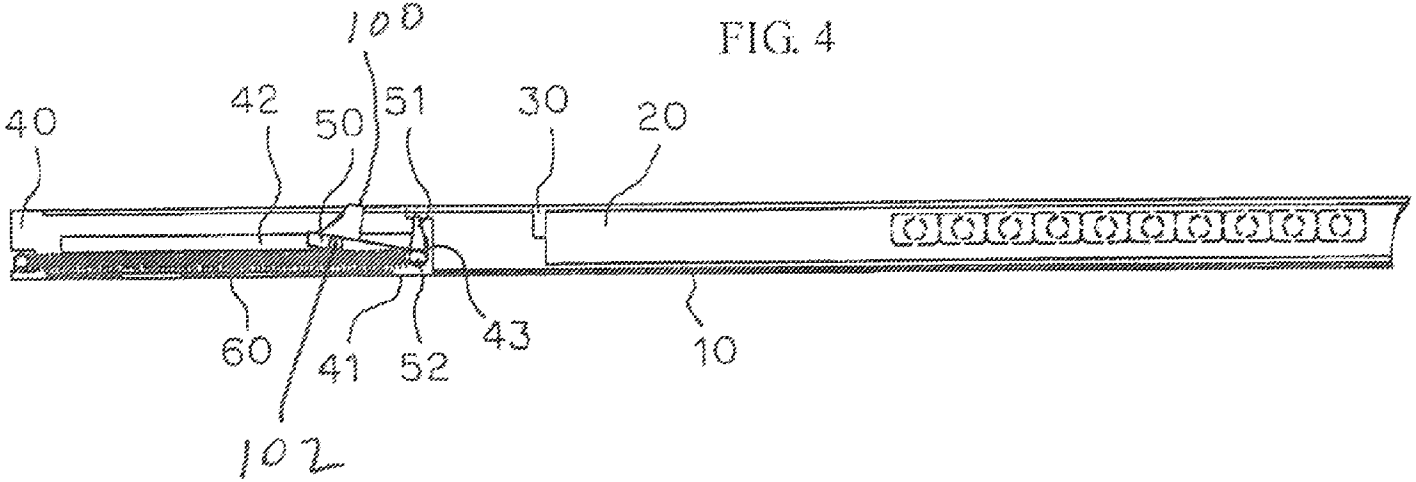
FIG. 4 is a schematic side view of the latch and catch engaged with one another.

In FIG. 4, in the side view, the catch 16 and latch 18 are engaged with one another and the catch is in the unlocked position within the channel (not shown in FIG. 4). The catch 16 has two pins 36 (only one of which is shown) that provide a pivot axis for the catch that extends laterally across the housing. The pivot axis is located approximately at a centre of the catch and is closer to the forward end than to the rearward end of the catch.

Figure 5:
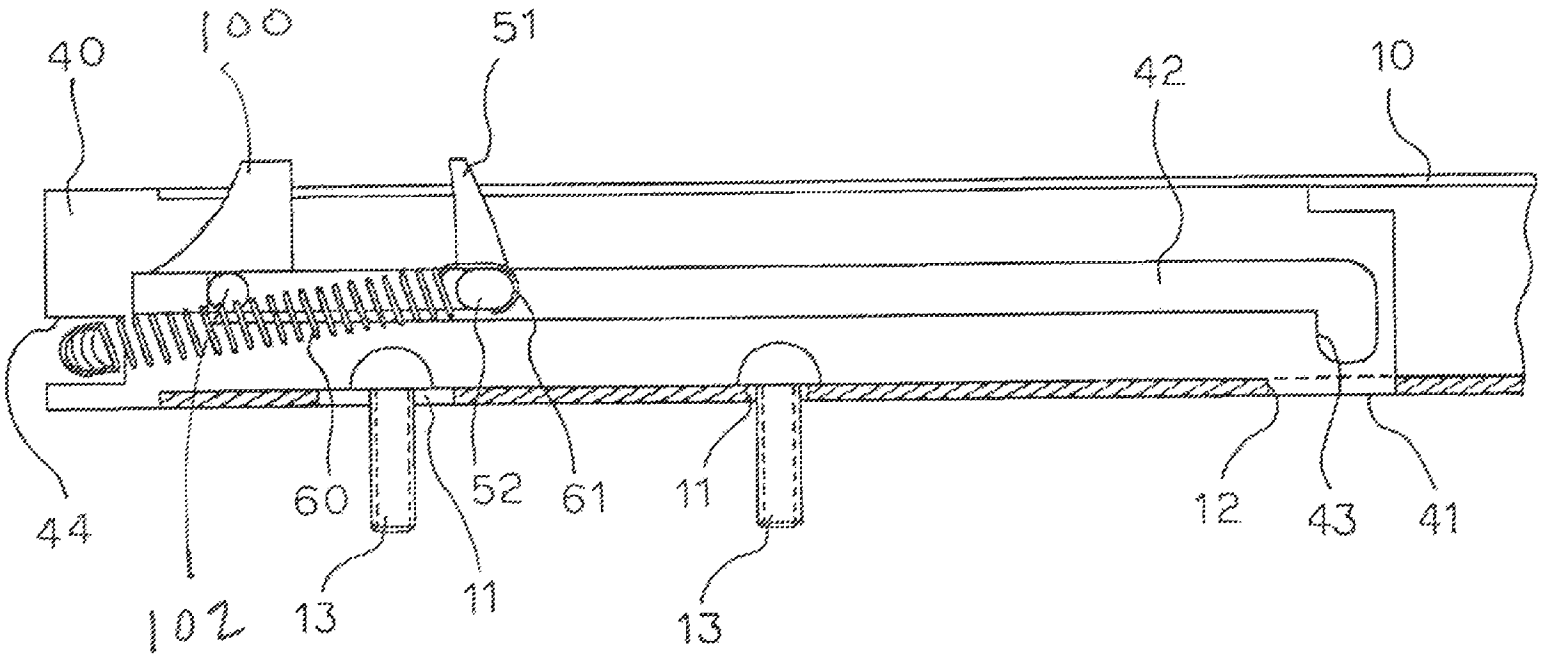
FIG. 5 is a schematic top view of the latch and catch engaged with one another.

In FIG. 5, there is shown a top view of the catch 16 in an unlocked position. In FIG. 5, there is shown a top view of the housing 10 with the catch 16 engaged with the latch 18 and the catch in an unlocked position. A slot 38 at an inner end of the housing 10 is sized to receive a tab (not shown) on the outer section 4 to at least partially affix the housing 10 to the inner end 12 of the outer section 4.

Figure 6:
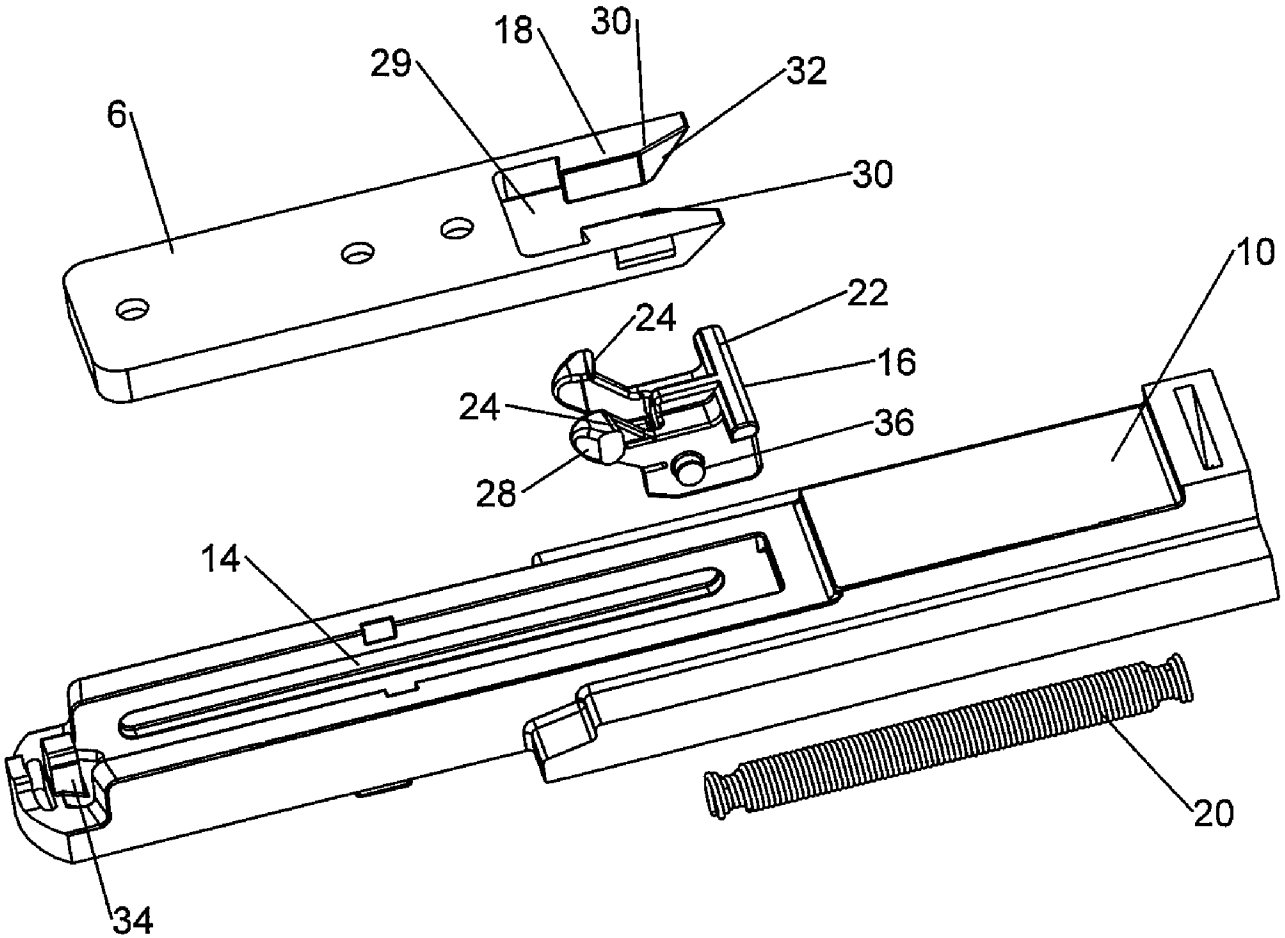
FIG. 6 is a schematic exploded perspective view of the latch and catch, spring and housing.

In FIG. 6, there is shown an exploded perspective view of the housing 10 and the latch 18 of the inner section 6. The catch has the two pins 36 (only one of which is shown) that fit within corresponding slots (not shown) within the housing (not shown in FIG. 6) for receiving the pins 36 which extend out either side of the catch 16 and into corresponding slots (not shown) in the channel. The pivot axis of the catch extends laterally across the housing. The pins are protrusions and are slidable in the slots on either side of the channel when the catch is in the unlocked position. The pivot axis is located at substantially the center of the catch between the rearward end and the forward end of the catch. The pivot axis is preferably located closer to the forward end than to the rearward end of the catch. The channel 14 is straight and the catch moves linearly from the inner end to the outer end of said channel. The path of the catch within the channel is always linear and is parallel to a path of the sections 4, 6, 8 and of the latch 18.

In the Orientation of the drawer slide 2 shown in FIGS. 1 and 2, when the catch is in the locked position, the rearward end of the catch is higher than the forward end, and when the catch is in the unlocked position, the forward end of the catch is higher than the rearward end when the drawer slide 2 is a vertical orientation as a side mounted drawer slide, when the catch is in the locked position,the rearward end of the catch is closer to a plane through said inner section than a forward end,and when the catch is is in the unlocked position, the forward end of the catch is closer to said plane through said inner section than the rearward end of the catch. When the catch returns to the inner end of the housing before engagement with the latch, the latch can be reset by being moved into engagement with the catch, by manually closing the drawer with which the slides are used. The closing of the drawer causes the latch to move laterally past the sides of the catch and into engagement with the catch with the drawer in the closed position.

The catch is symmetrical about a longitudinal center line of the housing when viewed from a top as shown in FIG. 5. The latch, housing and spring are also symmetrical about a longitudinal center line of the housing and of the drawer slide. The catch is biased to slide to the inner end of the channel when the catch is unlocked and there are no external forces on the slide, as occurs when the latch and catch are engaged with one another.

I claim:

1. A self-closing drawer slide comprising an outer longitudinal section and an inner longitudinal section mounted to telescopingly slide relative to one another, said slide being a side mounted drawer slide, a housing fixedly secured at an inner end of said outer section, said housing having a catch in a locked position at or near an outer end of said housing when said slide is in an open position and said inner slide has moved away from said housing, said catch being slidably mounted in a longitudinal linear channel formed in said housing, said catch being shaped to be engaged with a latch located on said inner section and unlocked in said channel when said latch contacts said catch as said slide moves from said open position of said slide to a closed position, said catch becoming disengaged from said latch and returning to said locked position as said inner section moves from said closed position toward said open position and said catch reaches an outer end of the channel, a spring extending between said catch and said housing to cause said catch to slide from said outer end of said housing along said channel to said inner end of said housing when said catch is in an unlocked position, thereby moving said slide to said closed position, said catch having a pivot axis that is located substantially at a center of said catch between a forward end and a rearward end thereof, said catch at said outer end of said channel moving from said locked position to said unlocked position by rocking rearward and moving from said unlocked position to said locked position by rocking forward about said pivot axis, said latch being shaped to reset the catch when the catch is in an unlocked position and disengaged from the latch, a forward end of the catch being laterally flexible, said latch being shaped to move the forward end of the catch laterally so that the latch can override the forward end of the catch and move into an engaged position with the catch.

2. A self-closing drawer slide as claimed in claim 1 wherein said pivot axis extends laterally across said housing and has two protrusions, there being one on either side of said catch, said protrusions extending into skits on either side of said channel, said slots being linear throughout their length, said protrusion being slidable in said slots when said catch is in said unlocked position.

3. A self-closing drawer slide as claimed in claim 1 wherein when said catch is in said locked position, said rearward end of said catch is higher than said forward end and when said catch is in an unlocked position, said forward end of said catch is higher than said rearward end.

4. A self-closing drawer slide as claimed in claim 1 wherein said latch is shaped to re-set said catch when said catch is in an unlocked position and disengaged from said latch, said catch having two legs at a front thereof that are separate and apart from one another and can be flexed laterally but are rigid longitudinally, said latch being shaped to squeeze said legs toward one another so that said latch can override said legs when said latch is moving toward said closed position to engage said catch, thereby re-setting said catch by engaging.

5. A self-closing drawer slide as claimed in claim 4 wherein said arms each have a free end with a bead thereon, there being two beads.

6. A self-closing drawer slide as claimed in claim 5 wherein said beads each have an outer side wall that converges: toward said forward end, there being two outer side walls, said latch having two elongated members with inner side walls that diverge toward said inner end, said inner side walls of said latch corresponding to said outer side walls of said catch and contacting said outer side walls of said catch to squeeze said arms together when said catch is in an unlocked position and disengaged from said latch.

7. A Self-closing drawer slide as claimed in claim 6 wherein said inner side walls of said latch force said arms of said catch to move laterally toward one another to allow said longitudinal members of said latch to override said arms, said arms being sufficiently resilient enough to spring outward when said inner side walls of said latch are out of contact with said outer side walls of said catch.

8. A self-closing drawer slide as claimed in claim 1 wherein said catch is formed of a single piece.

9. A self-closing drawer slide as claimed in claim 1 wherein said channel is straight.

10. A self-closing drawer slide as claimed in claim 1 wherein said catch has a forward end that is laterally flexible and said latch is shaped to reset said catch by flexing said forward end laterally as said latch moves into engagement with said catch.

11. A self-closing drawer slide as claimed in claim 10 wherein said catch is symmetrical about a longitudinal center line of said housing.

12. A self-closing drawer slide as claimed in claim 11 wherein when said catch is in said locked position, said rearward end of said catch is higher than said forward end, and when said catch is in said unlocked position, said forward end of said catch is higher than said rearward end, the catch having two legs at a front thereof that are separate and apart from one another and can be flexed laterally, but are rigid longitudinally.

13. A self-closing drawer slide comprising a plurality of longitudinal sections mounted to telescopingly slide relative to one another, said slide being a side mounted drawer slide, said sections being at least an outer section and an inner section, a housing located at an inner end of said outer section, said housing having a longitudinal linear channel therein with a catch slidably mounted in said channel, said catch having a pivot axis that is located substantially at a center of said catch between a forward end and a rearward end thereof, said catch having a locked position and an unlocked position within said housing, in said locked position said catch being locked at an outer end of said channel, in said unlocked position said catch being slidable from said outer end to an inner end of said channel, said catch being biased to said inner end of said channel by a spring to move said inner section and said slide to a closed position when said catch is unlocked, said catch moving from said locked position to said unlocked position by rocking rearward toward said rearward end such that said forward end is closer to a plane through said inner section than said rearward end and moving from said unlocked position to said locked position by rocking forward toward said forward end such that said rearward end is closer to said plane through said inner section than said forward end, said inner section having a latch at an inner end thereof, said latch being shaped to engage and simultaneously unlock said catch at the outer end of the channel when said inner section moves from, an open position of said slide toward a closed position and to disengage and simultaneously lock said catch in said locked position when said inner section moves from said inner end past said outer end of said housing as said slide moves toward said open position, said pivot axis having two protrusions, there being one protrusion on either side of said catch, said protrusions extending into slots on either side of said channel, said slots being linear throughout their length, said protrusions being slidable in said slots when said catch is in said unlocked position, said latch is shaped to reset said catch when said catch is in an unlocked position and disengaged from said latch, said catch having two legs of a front thereof that are separate and apart from one another and can be flexed laterally, but are rigid longitudinally, said latch being shaped to squeeze said lees toward one another so that said latch can override said legs when said latch is moving toward said closed position to engage said catch, thereby resetting said catch by engaging.

14. A self-closing drawer slide as claimed in claim 13 wherein said pivot axis of said catch extends laterally across said housing.

15. A self-closing drawer slide as claimed in claim 14 wherein said pivot axis is located closer to said forward end than to said rearward end of said catch.

16. A self-closing drawer slide comprising a plurality of longitudinal sections mounted to telescopingly slide relative to one another, said slide being a side mounted drawer slide, said sections being at least an outer section and an inner section, a housing located at an inner end of said outer section, said housing having a longitudinal linear channel therein with a catch slidably mounted in said channel, said catch having a pivot axis that is located substantially at a center of said catch between a forward end and a rearward end thereof, said pivot axis extending laterally across said housing, said catch having a locked position and an unlocked position within said housing, in said locked position said catch being locked at an outer end of said channel, in said unlocked position said catch being slidable from said outer end to an inner end of said channel, said catch being biased to said inner end of said channel by a spring to move said inner section and said slide to a closed position when said catch is unlocked, said catch moving from said locked position to said unlocked position by rocking rearward toward said rearward end such that said forward end is closer to a plane through said inner section than said rearward end and moving from said unlocked position to said locked position by rocking forward toward said forward end, such that said rearward end is closer to said plane through said inner section than said forward end, said inner section having a latch at an inner end thereof, said latch being shaped to engage and simultaneously unlock said catch at the outer end of the channel when said inner section moves from an open position of said slide toward a closed position and to disengage and simultaneously lock said catch in said locked position when said inner section moves from said, inner end past said outer end of said housing as said slide moves toward said open position, said pivot axis having two protrusions, there being one protrusion on either side of said catch, said protrusions extending into slots on either side of said channel, said slots being linear throughout their length, said protrusions being slidable in said slots when said catch is in said unlocked position, said latch being shaped to reset the catch when the catch is in an unlocked position and disengaged from the latch, a forward end of the catch being laterally flexible, said latch being shaped to move the forward end of the catch laterally so that the latch can override the forward end of the catch and move into an engaged position within the catch.

* * * * *